US007199724B2

(12) United States Patent
Danvir et al.

(10) Patent No.: US 7,199,724 B2
(45) Date of Patent: Apr. 3, 2007

(54) METHOD AND APPARATUS TO AIDE IN EMERGENCY EGRESS

(75) Inventors: Janice M. Danvir, Arlington Heights, IL (US); Marc K. Chason, Schaumburg, IL (US); Katherine M. Devanie, Arlington Heights, IL (US); David A. Hume, Deer Park, IL (US)

(73) Assignee: Motorola, Inc., Schaumburg, IL (US)

( * ) Notice: Subject to any disclaimer, the term of this patent is extended or adjusted under 35 U.S.C. 154(b) by 73 days.

(21) Appl. No.: 11/130,648

(22) Filed: May 17, 2005

(65) Prior Publication Data

US 2006/0261971 A1 Nov. 23, 2006

(51) Int. Cl.
*G08B 3/00* (2006.01)
*G08B 5/00* (2006.01)
*G08B 7/00* (2006.01)

(52) U.S. Cl. ..... 340/691.1; 340/540; 340/577; 340/628

(58) Field of Classification Search ..... 340/540, 340/577, 628, 691.1
See application file for complete search history.

(56) References Cited

U.S. PATENT DOCUMENTS

| | | | | |
|---|---|---|---|---|
| 4,801,928 | A * | 1/1989 | Minter | 340/691.2 |
| 5,572,183 | A * | 11/1996 | Sweeney | 340/691.4 |
| 6,150,943 | A * | 11/2000 | Lehman et al. | 340/628 |
| 7,026,947 | B2 * | 4/2006 | Faltesek et al. | 340/691.1 |
| 7,061,392 | B2 * | 6/2006 | Hawkinson | 340/691.1 |
| 2002/0057204 | A1 | 5/2002 | Bligh | |
| 2002/0072881 | A1 | 6/2002 | Saitta | |
| 2002/0149491 | A1 | 10/2002 | Crandall, Jr. et al. | |
| 2002/0191004 | A1 | 12/2002 | Ebersole et al. | |
| 2002/0196202 | A1 | 12/2002 | Bastian et al. | |
| 2004/0065813 | A1 | 4/2004 | Goldstein | |

* cited by examiner

*Primary Examiner*—Michael Horabik
*Assistant Examiner*—Samuel J Walk

(57) ABSTRACT

A method and apparatus are provided to aide in emergency egress of a structure. More particularly, egress indicators are co-located with hazard sensors. During detection of a hazard condition, locations of sensors detecting the hazard are identified and a pathway directing traffic away from the hazard is determined. Finally, the egress indicators are operated to direct traffic down the determined pathway.

11 Claims, 3 Drawing Sheets

100

METHOD AND APPARATUS TO AIDE IN EMERGENCY EGRESS

FIELD OF THE INVENTION

The present invention relates generally to emergency egress systems and in particular, to a method and apparatus to aide in emergency egress.

BACKGROUND OF THE INVENTION

Emergency egress systems typically comprise egress path indicators dispersed around a structure to aide in emergency evacuation of the structure. Typically the egress path indicators comprise lights that are activated when a hazard is detected. A problem exists with prior-art emergency egress systems in that when a hazard is detected, all egress path indicators are typically activated. The activation of all egress path indicators may direct individuals towards the hazard. For example, if a hazard (e.g., a fire) is located near an exit, the activation of prior-art emergency egress systems may direct individuals towards the hazard/exit. As is evident, during an emergency, it may be beneficial to direct individuals towards another exit, away from the hazard, even though they have a longer distance to travel. Therefore, a need exists for a method and apparatus to aide in emergency egress of a structure that directs individuals away from a hazard.

DETAILED DESCRIPTION OF THE DRAWINGS

In order to address the above-mentioned need, a method and apparatus are provided to aide in emergency egress of a structure. More particularly, egress indicators are co-located with hazard sensors. During detection of a hazard condition, locations of sensors detecting the hazard are identified and a pathway directing traffic away from the hazard is determined. Finally, the egress indicators are operated to direct traffic down the determined pathway.

Because egress indicators are co-located with hazard sensors, it is possible to identify those egress indicators that may direct traffic towards the hazard, thus making it possible to operate the egress indicators such that traffic is directed away from the hazard.

The present invention encompasses a method for operating an emergency egress system. The method comprises the steps of receiving a plurality of hazard indications, identifying locations of sensors detecting the hazard, and determining a path away from the hazard based on locations of the sensors detecting the hazard. A plurality of egress indicators are controlled to direct traffic towards the path, wherein the plurality of egress indicators are co-located with the sensors.

The present invention additionally comprises an apparatus comprising a receiver for wirelessly receiving an indication of a hazard condition, logic circuitry for identifying locations of sensors detecting the hazard, determining a path away from the hazard based on locations of the sensors detecting the hazard, and a transmitter for wirelessly controlling a plurality of egress indicators to direct traffic towards the path, wherein the plurality of egress indicators are co-located with the sensors.

The present invention additionally encompasses a method comprising the steps of detecting a hazard, wirelessly notifying a centralized controller of the hazard; receiving a message from the centralized controller in response to the notification, and operating an egress path indicator based on the received message.

Finally, the present invention encompasses an apparatus comprising hazard detection circuitry, a wireless transmitter for wirelessly notifying a centralized controller when hazard detection circuitry detects a hazard, and a wireless receiver for receiving messages from the centralized controller. An egress path indicator is provided along with logic circuitry for controlling the egress path indicator based on the messages received from the centralized controller.

Figure 1:
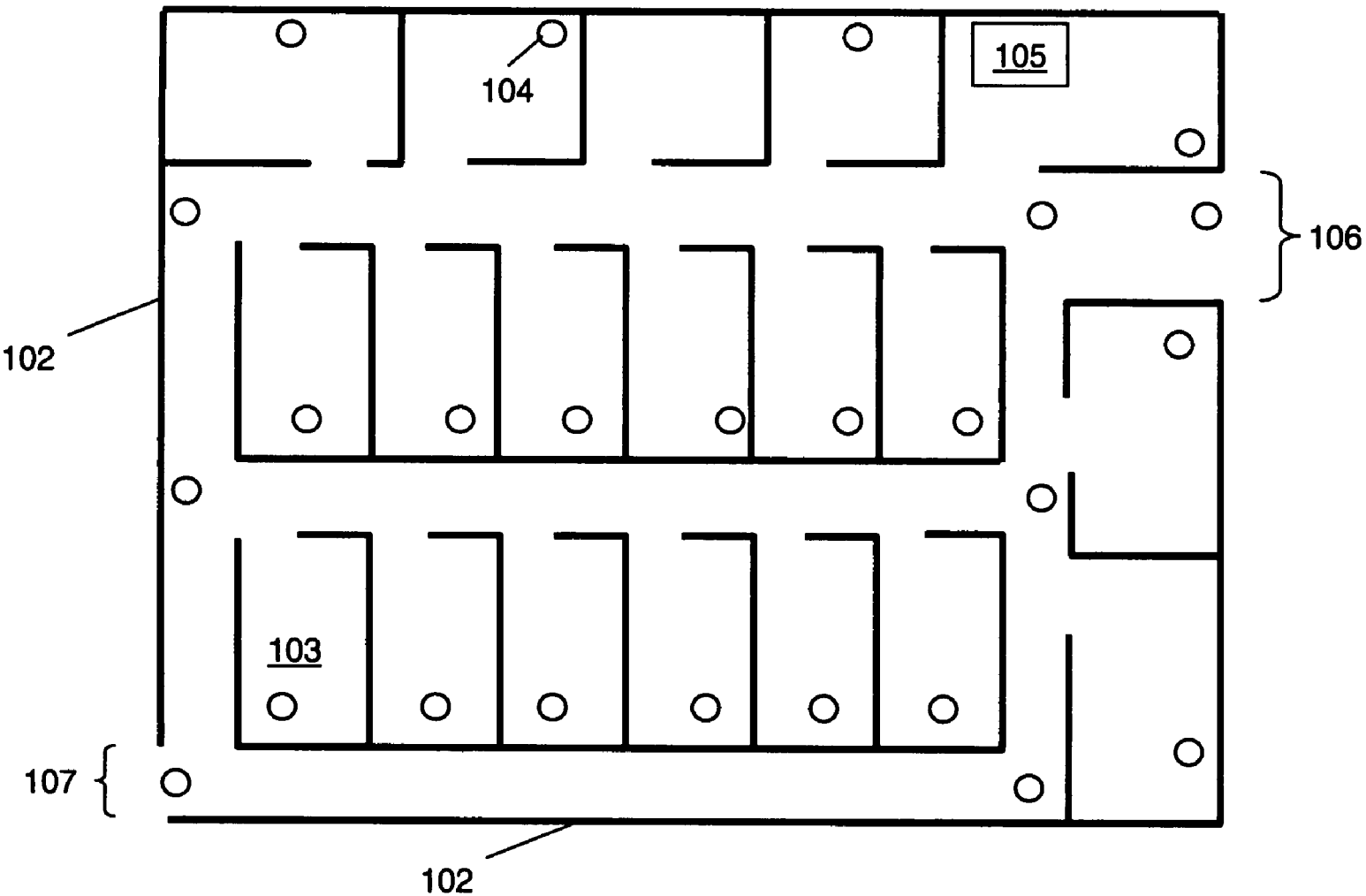
FIG. 1 is a block diagram showing an emergency egress system.

Turning now to the drawings, wherein like numerals designate like components, FIG. 1 is a block diagram showing emergency egress system 100 deployed over a floor plan of an interior of an office building. Egress system 100 comprises a number of wireless devices 104-105 involved in hazard detection and determining a safest egress pathway. As is evident, the office building comprises perimeter wall 102 that encloses a plurality of offices 103 (only one labeled). Two exits 106 and 107 exist to provide egress from the structure.

Circular objects represent egress indicators 104 (only one labeled), each comprising a wireless transceiver, hazard detection sensor/circuitry, and an egress path indicator. The locations of egress indicators 104 are known by system 100. Egress indicators 104 can include, for example, hazard detection circuitry and a transceiver attached to emergency lighting, hazard detection circuitry and a transceiver attached to audible indicators, exit signs, back up lighting, . . . , etc. Rectangular object 105 comprises a centralized control device 105 designed to determine a safe egress pathway. Control device 105 is provided with the locations of all egress indicators 104. The indicators may auto configure with a mesh network. Control device 105 may be a gateway with automatic notification to emergency responders.

It should be noted that although FIG. 1 shows egress indicators 104 existing within a two-dimensional space, one of ordinary skill in the art will recognize that egress indicators 104 may be located in other environments, including 3-dimensional spaces and outdoor spaces. For example, egress indicators 104 may comprise lightning detection circuitry located on a golf course used to direct individuals away from a potential lightning strike. Irrespective of the environment where egress indicators 104 operate, egress indicators 104 are dispersed in known locations to assist in locating a hazard and providing a safest pathway away from the hazard.

When any egress indicator 104 detects a hazard, the information is wirelessly provided to centralized control device 105, which analyzes which egress indicators detect the hazard, and determines a safest pathway away from the hazard. Centralized control device 105 then instructs various egress indicators 104 to operate in a manner to direct individuals along the safest pathway. Additionally, centralized control device 105 may be manually operated to activate predetermined egress paths. (ie. In the event of hazardous weather a predetermined path could be activated to direct people towards a tornado shelter)

As an example, if egress indicators 104 are equipped to detect fire activity, and a fire is detected near exit 106, system 100 will operate to direct traffic away from exit 106 and towards exit 107. The process of directing traffic is dependent upon the type of egress path indicator. The following set forth some examples of how egress system 100 may direct traffic away from a hazard.

If the egress path indicators comprise lighting, the lighting will be used to direct traffic towards the desired exit. For example, only those egress lights will be operated that will direct traffic accordingly.

If the egress path indicators comprise an audible warning system, the audible warning will direct traffic towards a desired exit.

If the egress path indicators comprise standard commercial or industrial lighting used in corridors, such lighting may be equipped with supplementary red and green lights to be actuated accordingly.

If the egress path indicators comprise a modifiable exit sign (e.g., one with a pixilated image) such an exit sign could change from the word "EXIT" to a directional arrow.

If the egress path indicators comprise dual display egress lights capable of changing a directional arrow, such signs can be modified to a ⊗ or Ø symbol instead of a directional arrow.

If the egress path indicators comprise sequenced lighting, the sequenced lighting along corridor or ceiling panel lights could be sequenced for directionality. In other words, the lighting may be activated such that the egress path indicators appear to flow towards an egress direction.

Figure 2:
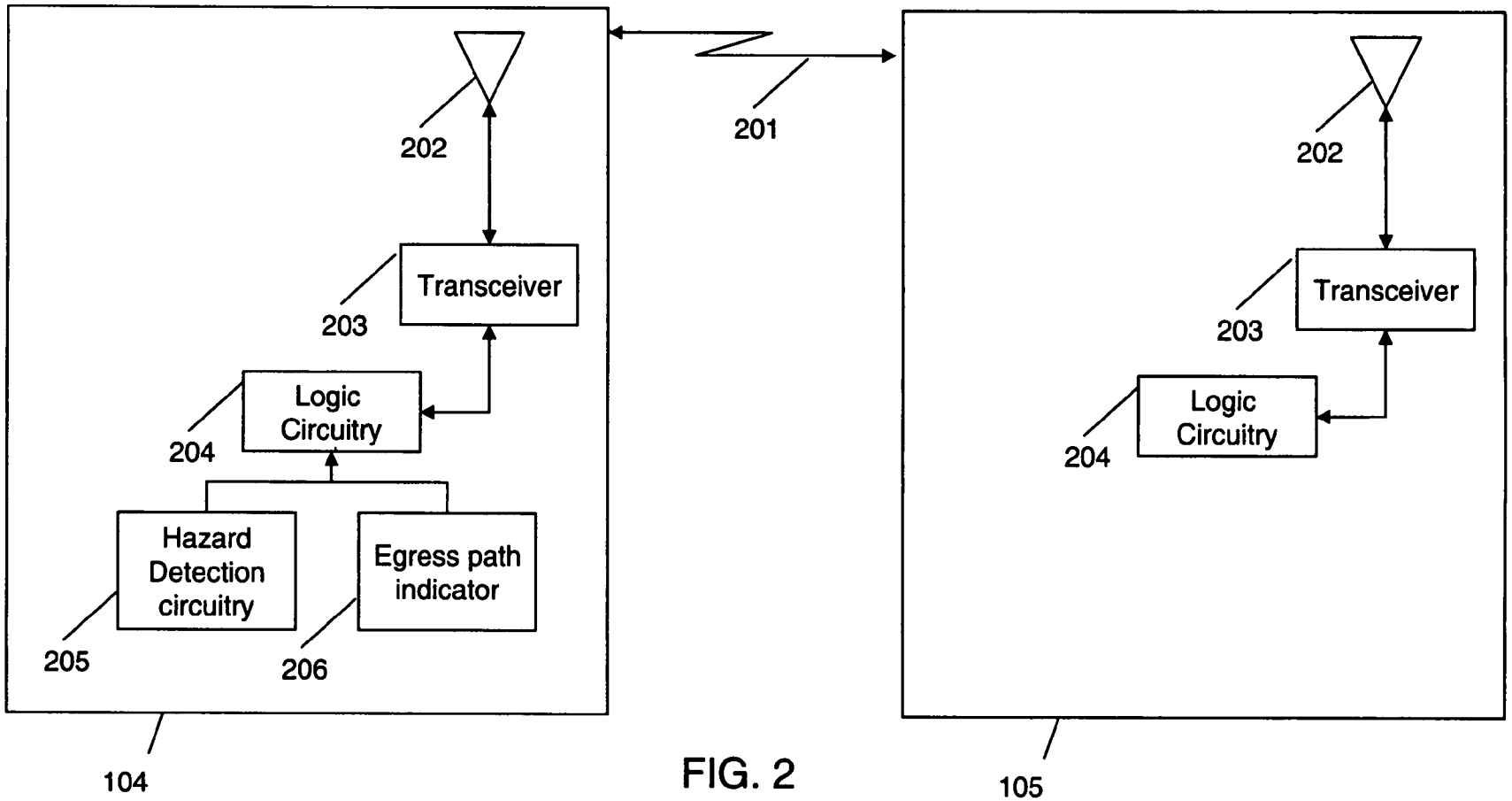
FIG. 2 is a block diagram of an egress indicator.

FIG. 2 is a block diagram of an egress indicator 104 and centralized control device 105. Both indicator 104 and centralized control device 105 comprises antenna 202 coupled to transmitter/receiver (transceiver) 203, in turn, coupled to logic circuitry 204. Although various forms for antenna 202, transceiver 203, and logic circuitry 204 are envisioned, in a preferred embodiment of the present invention egress indicator 104 is formed with a wireless self assembling system with a mesh overlay. Such a system can be realized in an 802.15.4 chipset, for example a Freescale Inc. MC13192 transceiver 203 coupled to a Motorola HC08 8-bit processor 204.

As is evident, egress indicator 104 additionally comprises hazard detection circuitry 205 coupled to logic circuitry 204. In the preferred embodiment of the present invention hazard detection circuitry comprises standard fire detection circuitry; however, in alternate embodiments of the present invention other forms of hazard detection circuitry 205 may exit. Such other forms include, but are not limited to detectors that detect smoke, heat, flood water, chemicals, hazardous gases or byproducts such as radiation or carbon monoxide, . . . , etc.

Additionally, egress indicator 104 comprises egress path indicator 206 coupled to logic circuitry 204. In the preferred embodiment of the present invention egress path indicator 206 comprises emergency exit lighting; however, in alternate embodiments other path indicators 206 may be employed.

When hazard detection circuitry 205 detects a hazard, logic circuitry 204 is notified. This event is wirelessly transmitted to centralized controller 105 along with an identification of the egress indicator 104. Once received by the centralized controller's transceiver 203, logic circuitry 204 is passed the message and immediately determines other egress indicators 104 sensing the hazard. The locations of the hazards are analyzed and a best egress pathway is identified by the centralized controller's logic circuitry 204. The centralized controller's logic circuitry will then utilize transceiver 203 to wirelessly instruct various egress path indicators 206 to activate. More particularly, wireless signal 201 will be transmitted to all egress indicators 104 that will need to activate their egress path indicators 206. Once the message is received by egress indicators 104, logic circuitry 204 analyzes the message and determines whether or not to activate egress path indicator 206. Egress indicators 104 will engage their egress path indicators only if instructed to do so.

Figure 3:
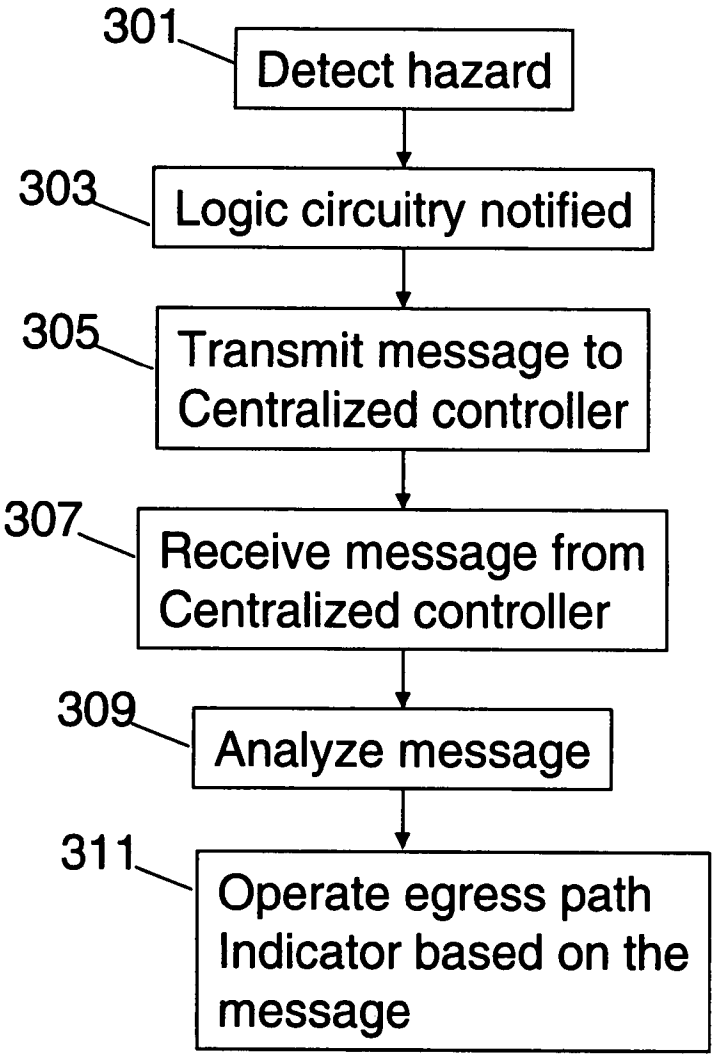
FIG. 3 is a flow chart showing operation of the emergency egress system of FIG. 1.

FIG. 3 is a flow chart showing operation an egress indicator of FIG. 2. The logic flow begins at step 301 where hazard detection circuitry 205 detects a hazard condition. As discussed above, the hazard condition may comprise an indication of smoke, heat, flood/water, chemicals, gases, or radiation detected via a smoke detector, a heat detector, a flood/water detector, a chemical detector, a hazardous gases or byproducts detector, or a radiation detector.

Continuing, once a hazard is detected, this fact is passed to logic circuitry 204 (step 303) and logic circuitry 204 instructs transmitter/receiver 203 to wirelessly transmit a message of the hazard detection along with the identification of egress indicator 104 to centralized processor 105 (step 305). In response, transmitter/receiver 203 receives a wireless message from centralized controller 105 (step 307). The message is analyzed by logic circuitry 204 (step 309) and the egress path indicator 206 is operated based on the message (step 311).

It should be noted that for audible systems, the message received from centralized controller 106 may be an audible message to announce via egress path indicator 206. In this situation egress indicator 206 will automatically be activated announcing the received massage.

In yet a further embodiment of the present invention, egress path indicator 206 may comprise directional lighting that may operate to direct individuals along one of several paths. In this situation the message received from centralized controller 106 will indicate how to operate egress path indicator 206 to direct individuals along a safest path.

Figure 4:
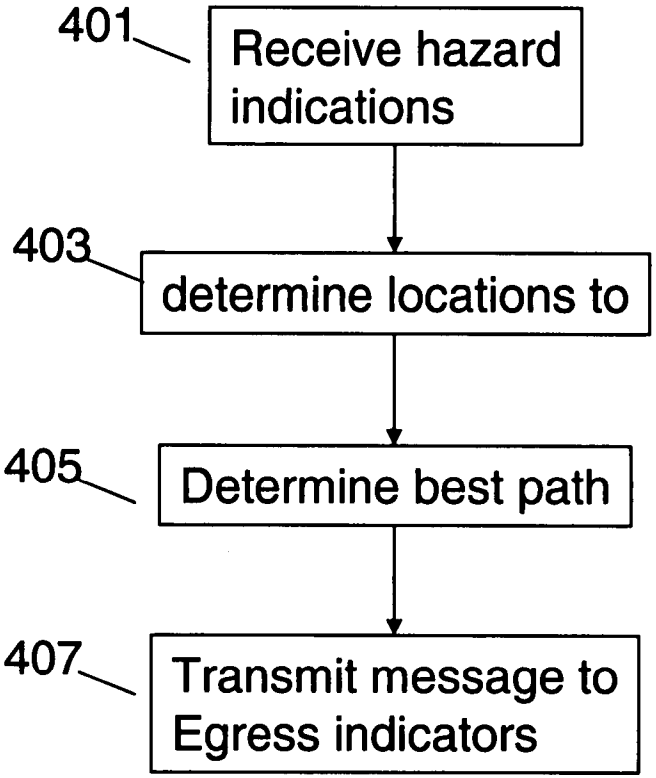
FIG. 4 is a flow chart showing operation of the egress indicator of FIG. 2.

FIG. 4 is a flow chart showing operation of centralized controller 106 of FIG. 2. The logic flow begins at step 401 where at least one hazard indications is wirelessly received from a hazard detector via over-the-air signals 201. The hazard indications may comprise indications from detectors such as a smoke detector, a heat detector, a flood/water detector, a chemical detector, a hazardous gases or byproducts detector, or a radiation detector. Additionally, hazard indication messages comprise the identification of the circuitry detecting the hazard.

At step 403, logic circuitry receives the messages and determines the locations of the circuitry detecting the hazard. Based on this information a best egress path is determined at step 405. Finally, at step 407 appropriate instructions are wirelessly transmitted to control egress indicators 104. The appropriate instructions may, for example, control lighting, control an audible warning system, control a modifiable exit sign, control a directional arrow, control sequenced lighting, . . . etc.

For example, if egress path indicators 206 comprise emergency lighting, instructions on which indicator 104 to operate may be given. Alternatively, if egress path indicators 206 comprise an audible warning system, an appropriate message (e.g., "proceed to Northwest exit") may be transmitted to all egress indicators 104. In yet a further embodiment of the present invention, if egress path indicator 206 may comprise directional lighting an appropriate message may be transmitted to all egress indicators 104, properly instructing them in the operation of their lighting.

While the invention has been particularly shown and described with reference to a particular embodiment, it will be understood by those skilled in the art that various changes in form and details may be made therein without departing from the spirit and scope of the invention. For example, while the above embodiment shows egress path indicators and hazard detection circuitry existing within the same device, one of ordinary skill in the art will recognize that these devices may simply be located in close proximity to each other. It is intended that such changes come within the scope of the following claims.

The invention claimed is:

1. A method for operating an emergency egress system, the method comprising the steps of:

receiving a plurality of hazard indications;

identifying locations of sensors detecting the hazard;

determining a path away from the hazard based on locations of the sensors detecting the hazard; and sequencing a plurality of ceiling panel lights to direct traffic towards the path, wherein the plurality of ceiling panel lights are co-located with the sensors.

2. The method of claim 1 wherein the step of receiving the plurality of hazard indications comprises the step of receiving a wireless transmission from at least one hazard detector.

3. The method of claim 1 wherein the step of receiving the plurality of hazard indications comprises the step of receiving a wireless transmission from at least one hazard detector, and wherein the hazard detector is taken from the group consisting of a smoke detector, a heat detector, a flood/water detector, a chemical detector, a hazardous gases or byproducts detector, and a radiation detector.

4. The method of claim 1 wherein the step of controlling a plurality of ceiling panel lights comprises the step of wirelessly controlling the plurality of ceiling panel lights.

5. An apparatus comprising:

a receiver for wirelessly receiving an indication of a hazard condition;

logic circuitry for identifying locations of sensors detecting the hazard, determining a path away from the hazard based on locations of the sensors detecting the hazard; and a transmitter for wirelessly sequencing a plurality of ceiling panel lights to direct traffic towards the path, wherein the plurality of ceiling panel lights are co-located with the sensors.

6. The apparatus of claim 5 wherein the indication of the hazard comprises an indication of smoke, heat, flood/water, chemicals, gases, or radiation.

7. A method comprising the steps of:

detecting a hazard;

wirelessly notifying a centralized controller of the hazard;

receiving a message from the centralized controller in response to the notification; and sequencing ceiling panel lights based on the received message.

8. An apparatus comprising:

hazard detection circuitry;

a wireless transmitter for wirelessly notifying a centralized controller when hazard detection circuitry detects a hazard;

a wireless receiver for receiving messages from the centralized controller;

an egress path indicator; and logic circuitry for sequencing ceiling panel lights based on the messages received from the centralized controller.

9. The method of claim 1 wherein the step of sequencing the plurality of ceiling panel lights comprises the step of wirelessly transmitting instructions to the plurality of lights causing them to sequence.

10. The apparatus of claim 7 wherein the step of sequencing the ceiling panel lights comprises the step of wirelessly transmitting instructions to the plurality of lights causing them to sequence.

11. The apparatus of claim 8 wherein the logic circuitry sequences the ceiling panel lights by wirelessly transmitting instructions to the of lights causing them to sequence.

* * * * *